US005601183A

United States Patent [19]

Boyd et al.

[11] Patent Number: 5,601,183

[45] Date of Patent: *Feb. 11, 1997

[54] TWO-POLE MAKE-BEFORE-BREAK SWITCH

[75] Inventors: M. Douglas Boyd, Hanover Park; Tom J. Oshgan, Mount Prospect; Robert Krawczyk, Rolling Meadows, all of Ill.

[73] Assignee: Eaton Corporation, Cleveland, Ohio

[ * ] Notice: The terminal 43 months of this patent has been disclaimed.

[21] Appl. No.: 792,966

[22] Filed: Nov. 15, 1991

[51] Int. Cl.[6] ..... H01H 1/60; H01H 1/46

[52] U.S. Cl. ..... 200/553; 200/558; 200/559; 200/339

[58] Field of Search ..... 200/460, 445, 200/448, 459, 461, 463, 447, 339, 553, 559, 532, 6 R, 1 B, 557, 558; 128/205.22, 202.22, 204.21, 204.22, 204.23

[56] References Cited

U.S. PATENT DOCUMENTS 2,400,754 5/1946 Hausler ..... 200/447
3,497,649 2/1970 Ball ..... 200/445
4,689,450 8/1987 Sawada ..... 200/6 R

FOREIGN PATENT DOCUMENTS 1161119 8/1969 United Kingdom ..... 128/202.22

*Primary Examiner*—Henry J. Recla
*Assistant Examiner*—David J. Walczak
*Attorney, Agent, or Firm*—R. A. Johnston

[57] ABSTRACT

A two-pole make-before-break switch includes a base housing, a cover member secured to the base housing, an actuating member disposed above the cover member, and first and second contact assemblies mounted on an interior portion of the base housing. The first contact assembly includes a normally-open common contact blade member that is closed prior to the closing of another set of normally-open contacts with a snap action in a second contact assembly so as to complete an electrical connection. The switch is operable by depressing the actuator member either in a first direction to effect a manual-up mode of operation or in a second direction to effect down modes of operation.

15 Claims, 3 Drawing Sheets

TWO-POLE MAKE-BEFORE-BREAK SWITCH

BACKGROUND OF THE INVENTION

This invention relates generally to electrical switches and more particularly, it relates to a two-pole make-before-break switch which includes a first contact assembly having a normally-open common contact blade member that is closed prior to closing of another set of normally-open contacts in a second contact assembly so as to complete an electrical connection.

As is generally known, there are a variety of prior art switches which are used to control electrical loads such as motors, lamps, heaters, and any other devices requiring electrical power. The design of a particular switch is often optimized dependent upon the type of load being controlled or switched. When the type of load is inductive, there is typically a very high voltage generated across the switch contacts that first open so as to "break" the current flowing through the inductive load since the current cannot be changed instantaneously. As a result, this high voltage can sometimes cause material to be transferred from one contact to the other contacts thereby creating a very common "pitting" effect on the switch contacts during its use. Therefore, these deposits might impair the effectiveness of the electrical connection between the switch contacts and thus shorten the useful life of the switch.

Another problem encountered with switches that switch high currents is that of low contact force and a subsequent high contact resistance occurring when the switch contacts are first closed. This high resistance may cause the switch contacts to heat up significantly so as to render deformation of material within the switch and sometimes may actually cause the switch contacts to become welded together and thus creating a switch failure and reducing its reliability. This problem is particularly noticeable in the types of switches in which the contact interface is allowed to be "teased" in and out of closure by the operator. For this reason, switches that control high currents are usually designed so as to yield a high contact pressure which is somewhat independent of the force applied to the switch.

In view of the increased public demand for the capability of operating a driver's side window in an automotive vehicle in both a manual lowering mode and an automatic (free run) lowering mode (referred to as "express down" or "one-touch down"), there has arisen a need in the automotive industry for a switch which can implement this feature but yet avoids the problems discussed above. In order to achieve this "automatic-down" feature using solid-state electronics, the switch is required to have one of the set of contacts on the common blade be suspended in a normally-open state.

As a result of this needed feature, the inventors have developed a new switching arrangement which incorporates a first contact assembly having the normally-open common contact blade member that makes contact prior to closing of another set of normally-open contacts by a "snap-action" in a second contact assembly to produce the completed circuit path, thereby maintaining the reliability of the basic mechanical switch. Consequently, the failure on the normally-open common contact blade member has been substantially reduced or eliminated, thereby prolonging the useful life of the switch.

SUMMARY OF THE INVENTION

Accordingly, it is a general object of the present invention to provide an improved two-pole make-before-break switch which is relatively simple and economical to manufacture and assemble, but yet overcomes the problems of the prior art.

It is an object of the present invention to provide an improved two-pole make-before-break switch which includes a switch contact switching sequence for maintaining a high reliability.

It is another object of the present invention to provide an improved two-pole make-before-break switch which can be readily used in conjunction with a driver's window motor and additional electronics in an automotive vehicle so as to create an "automatic-down" feature.

It is still another object of the present invention to provide an improved two-pole make-before-break switch which includes a first contact assembly having a normally-open common contact blade member that is closed prior to closing of another set of normally-open contacts with a snap action in a second contact assembly to produce a completed circuit path.

In accordance with these aims and objectives, the present invention is concerned with the provision of improved two-pole make-before-break switch which includes a base housing, a cover member secured to the base housing, an actuating member disposed above the cover member, and first and second contact assemblies mounted on an interior portion of the base housing. The first contact assembly is formed of a first common contact blade member having a first contact element, an upper resilient blade member having a second contact element, and a lower fixed blade member having a third contact element. The first, second and third contact elements are electrically connected to a first terminal, a second terminal, and a third terminal respectively disposed on the bottom exterior of the base housing. A spacer is provided for suspending the first contact element between the second and third contact elements when the switch is in the unactivated state. The upper resilient blade member is movable between a first position where the second contact element is spaced apart from the first contact element and a second position where the second contact element is in engagement with the first contact element.

The second contact assembly includes a second common blade member having a fourth contact element, an upper fixed blade member having a fifth contact element, and a lower fixed blade member having a sixth contact element. The fourth, fifth and sixth contact elements are electrically connected to a fourth terminal, the second terminal, and a fifth terminal respectively disposed on the bottom exterior of the base housing. The second common contact blade member is movable with a snap action between a first position where the fourth contact element is in engagement with the fifth contact element and a second position where the fourth contact element is engagement with the sixth contact element.

The actuating member initially moves the upper resilient blade member of the first contact assembly so as to cause engagement of the first and second contact elements prior to the moving of the second common contact blade member so as to cause the snap action engagement of the fourth and sixth contact elements during a manual-up mode of operation. In down modes of operation, the first common contact blade member is moved with a snap action so as to cause engagement of the first contact element with the third contact element.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1:
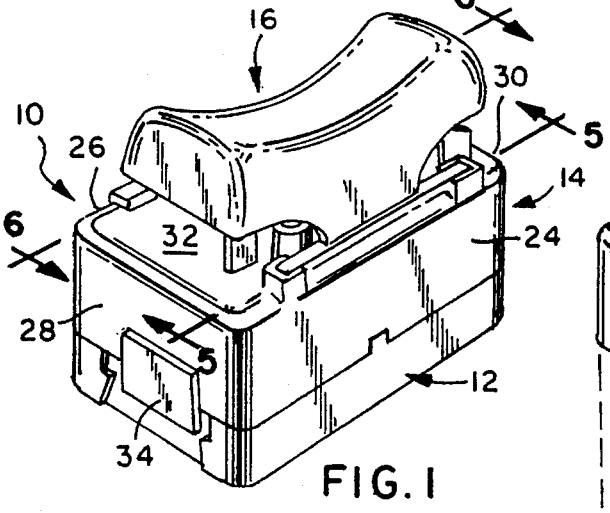
FIG. 1 is a perspective view of a two-pole make-before-break switch, constructed in accordance with the principles of the present invention.
Figure 2:
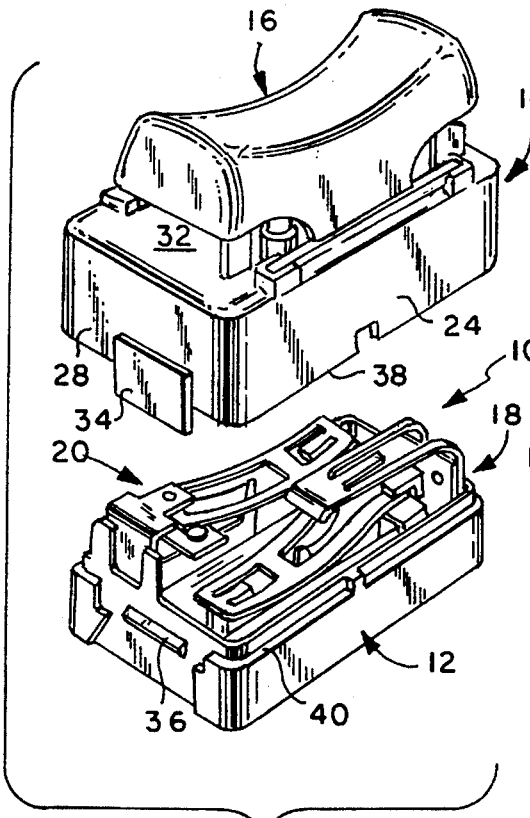
FIG. 2 is a perspective view of the switch of FIG. 1 with the cover member separated from the base housing.
Figure 3:
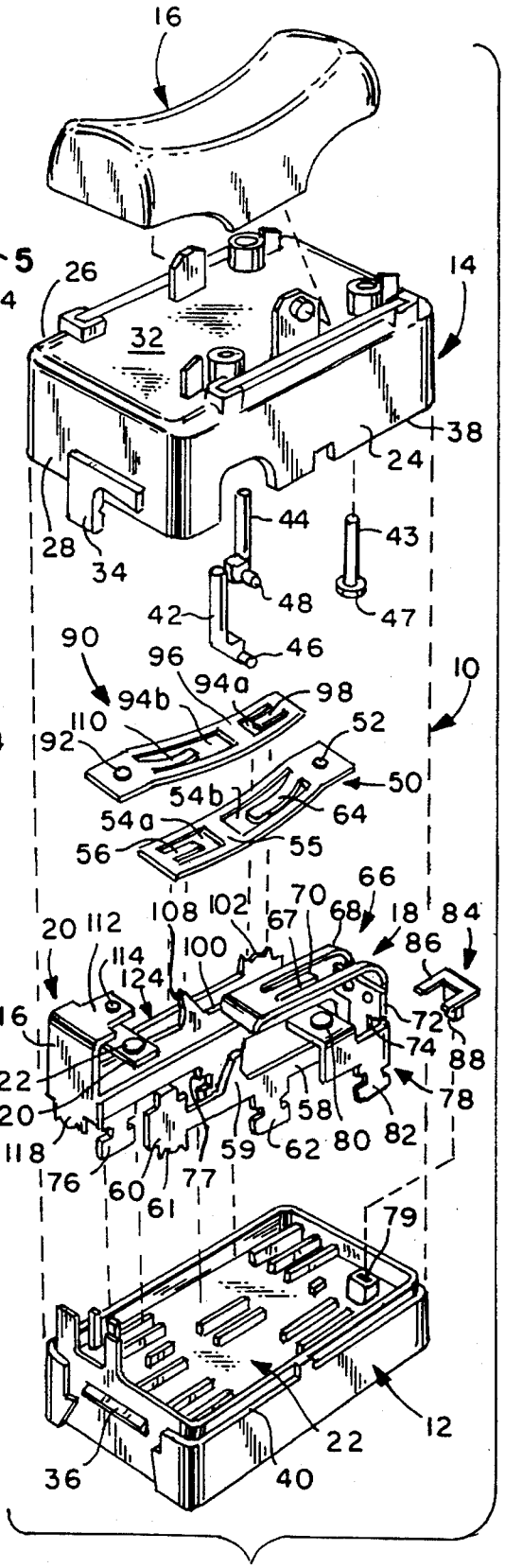
FIG. 3 is an exploded perspective view of the switch of FIG. 1.
Figure 4:
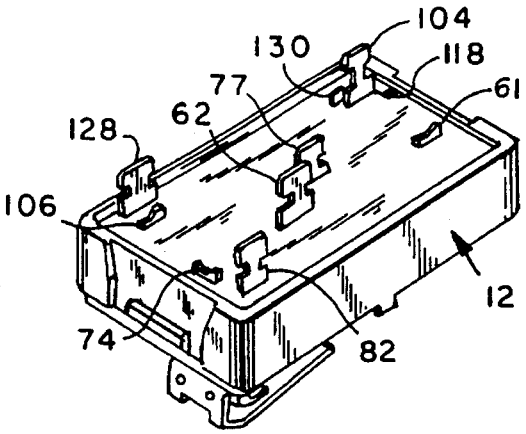
FIG. 4 is a bottom view of the switch of FIG. 1.

Referring now in detail to the various views of the drawings, there is illustrated and generally indicated by reference numeral 10 in FIGS. 1 through 11 a two-pole make-before-break switch constructed in accordance with the principles of the present invention. A two-pole switch 10 is comprised of a base housing 12 and a cover member 14 which is adapted to be snapped into interlocking engagement with the base housing. A rocking-type actuating member 16 is formed above the top surface of the cover member 14. The switch further includes first and second contact assemblies 18 and 20, which are operative for making and breaking electrical connections between various electrical terminals mounted on the bottom surface of the base housing 12, as will hereinafter be more fully set forth.

The base housing 12 is formed of a generally rectangular-shaped design and is preferably integrally molded from a suitable electrical insulating material such as plastic or nylon. The housing 12 includes a cavity 22 on its interior portion in which are mounted the first and second contact assemblies 18 and 20. The cover member 14 is also preferably integrally molded from a suitable electrical insulating material and has a generally rectangular open inverted box-like configuration. The cover member 14 is defined by sidewalls 24 and 26, endwalls 28 and 30, and a topwall 32. Each of the endwalls 28 and 30 is provided with a mating tab 34 which is adapted to lockingly engage with respective projection 36 formed on the ends of the base housing 12. Further, the sidewalls and endwalls are provided with a free edge 38 which is dimensioned and configured to be received and secured in the ledge 40 formed in the housing 12.

The rocking-type actuating member 16 is likewise preferably integrally molded from a suitable electrical insulating material and has a generally rectangular shape. Extending from the underneath side of the actuating member are first, second and third plunger rods 42, 43 and 44 which are located in a spaced apart relationship from each other. The plunger rods extend downwardly through openings formed in the topwall 32 of the cover member 14. The lower ends of the first, second and third plunger rods 42, 43 and 44 are provided integrally with respective stem portions 46, 47 and 48 for effecting operation of the first and second contact assemblies 18 and 20 so as to make and break electrical connections, as will be presently described.

The first contact assembly 18 is preferably formed of a suitable resilient conductive metallic material such as beryllium copper and comprises a first contact blade member 50. The first common contact blade member includes a movable contact element 52 disposed at its one end. The contact blade member 50 is generally rectangular in shape and includes first and second C-shaped openings 54*a*, 54*b* separated by an intermediate portion 55. The intermediate portion 55 is dimensioned so that when the first contact assembly 18 is installed in the housing 12, the stem portion 46 of the first plunger rod 42 will be in contact engagement with the top surface of the intermediate portion 55. A center arm member 56 is formed integrally with the end of the blade member 50 opposite the contact element 52 and extends into the first opening 54*a*.

An elongated first terminal member 58 is disposed in the interior portion of the housing 12. The first terminal member 58 includes a mounting post 60 formed integrally on its one end and a first terminal 62 formed integrally on its other end. The upper end of the mounting post 60 is fixedly secured to the center arm member 56. The lower end of the mounting post 60 has prongs 61 which extend through an opening in the housing 12 so as to secure the elongated first terminal member 58. The free end of the first terminal 62 extends through an opening in the housing to the bottom or underside thereof. The first terminal 62 on the bottom exterior of the housing is electrically connected to the first common contact blade member 50.

The elongated terminal member 58 also includes an inverted V-shaped fulcrum member 59 which extends upwardly from its intermediate area. A bowed thin leaf compression member 64 is formed integrally at its one end with the end of the blade member 50 adjacent the contact element 52 and extends into the second C-shaped opening 54*b*. The other end of the compression member 64 is secured in compression to the fulcrum member 59.

The first contact assembly 18 further includes an upper resilient blade member 66. The blade member 66 is formed of a center leaf 67 and a pair of side leaves 68 integrally connected to the center leaf their one ends. The free end of the center leaf 67 has a movable contact element 70. The center leaf 67 is dimensioned and confined so that when the blade member 66 is installed in the housing the stem portion 47 of the plunger rod 43 will be in contact engagement with the upper surface thereof, which is effectively used for moving the contact element 70 of the blade member 66 into engagement with the contact element 52 of the blade member 50. The other ends of the side leaves 68 extend downwardly and are joined to a mounting post 72. The mounting post 72 includes prongs 74 which extend downwardly through an opening in the housing for securing the blade member 66 to the housing.

An elongated second terminal member 76 is disposed in the interior portion of the housing. One end of the second terminal member 76 is formed integrally with the mounting post 72. In the intermediate area of the second terminal member, there is provided a second terminal 77 which extends through an opening in the housing to the bottom or underside thereof. The second terminal 77 on the exterior portion of the housing is electrically connected to the upper blade member 66.

The first contact assembly 18 also includes a lower fixed blade member 78 which has a fixed contact element 80 and a third terminal 82 formed integrally with the blade member 78. The third terminal 82 extends through an opening in the housing to the bottom or underside thereof. The third terminal on the bottom exterior of the housing is electrically connected to the fixed blade member 78. A spacer 84 has a U-shaped portion 86 which supports the first common contact blade member 50 adjacent the contact element 52 so as to suspend the contact element 52 between the upper and lower contact elements 70 and 80 when the switch is in the unactivated state. The spacer 84 has a base portion 88 which extends downwardly from the center of the U-shaped portion 86 and is snapped into a recess 79 formed in the base housing 12.

The second contact assembly 20 is located parallel to and adjacent to the first contact assembly 18 in the base housing 12. The second contact assembly is also preferably formed of a suitable resilient conductive metallic material such as beryllium copper and is very similar in its construction to the first contact assembly 18. In particular, the second contact assembly is comprised of a second common contact blade member 90 which includes a movable contact element 92 disposed at its one end. The second common contact blade member 90 is generally rectangular in shape and includes first and second C-shaped openings 94*a*, 94*b* separated by an intermediate portion 96. The intermediate portion 96 is dimensioned so that when the second contact assembly 20 is installed in the housing 12, the stem portion 48 of the third plunger rod 44 will be in contact engagement with the intermediate portion 96.

A center arm member 98 is formed integrally with the end of the second common contact blade member 90 opposite the contact element 92 and extends into the first C-shaped opening 94*a*. An elongated fourth terminal member 100 is disposed in the interior portion of the base housing 12. The fourth terminal member 100 includes a mounting post 102 formed integrally on its one end and a fourth terminal 104 formed integrally on its other end. The upper end of the mounting post 102 is fixedly secured to the center arm member 98. The lower end of the mounting post 102 has prongs 106 which extend through an opening in the housing so as to secure the elongated fourth terminal member 100 to the housing. The free end of the fourth terminal 104 extends through an opening in the housing to the bottom or underside thereof. The fourth terminal 104 on the bottom exterior of the housing is electrically connected to the second common contact blade member 90.

The elongated terminal member 100 also includes an inverted V-shaped fulcrum member 108 which extends upwardly from its intermediate area. A bowed thin leaf compression member 110 is formed integrally at its one end with the end of the second common contact blade member 90 adjacent the contact element 92 and extends into the second C-shaped opening 94*b*. The other end of the compression member 110 is secured in compression to the fulcrum member 108.

The second contact assembly 20 further includes an upper fixed blade member 112 having a fixed contact element 114 and a mounting post 116 formed integrally with the blade member 112. The mounting post 116 includes prongs 118 which extend downwardly through an opening in the housing for securing the blade member 112 to the housing. The mounting post 116 is also formed integrally with the other end of the second terminal member 76. As a result, the second terminal 77 on the bottom exterior of the housing is also electrically connected to the upper fixed contact blade 112.

The second contact assembly 20 also includes a lower fixed blade member 120 which has a fixed contact element 122. An elongated fifth terminal member 124 is disposed in the interior portion of the housing. The fifth terminal member 124 includes a mounting post 126 formed integrally on its one end and a fifth terminal 128 formed integrally on its other end. The mounting post 126 has its upper end formed integrally with the lower fixed contact blade member 120. The lower end of the mounting post 126 includes prongs 130 extending through an opening in the housing for securing the fifth elongated terminal member to the housing. The free end of the fifth terminal 128 extends through an opening in the housing to the bottom or underside thereof. The fifth terminal 128 on the bottom exterior of the housing is electrically connected to the lower fixed contact member 120.

Referring now to FIGS. 11(*a*) through 11(*e*) of the drawings, there are shown schematic circuit diagrams of the switch 10 used in conjunction with a motor M for controlling the upward movement of a driver's side window in an automotive vehicle. As can be seen, the ends of the motor M are electrically coupled between the first common contact blade member 50 via the first terminal 62 and the second common contact blade member 90 via the fourth terminal 104. As a result, the switch 10 can be electrically connected to a power source IGN and ground return so that the driver's side window is operable in either manual-up, manual-down, or automatic-down modes.

Figure 5:
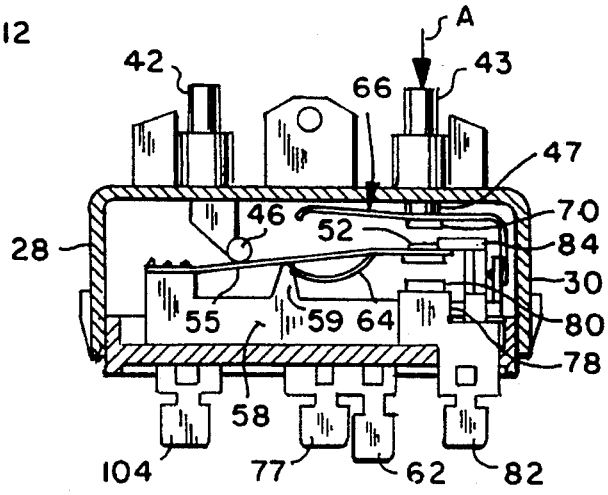
FIG. 5 is a cross-sectional view, taken along the lines 5—5 of FIG. 1.
Figure 6:
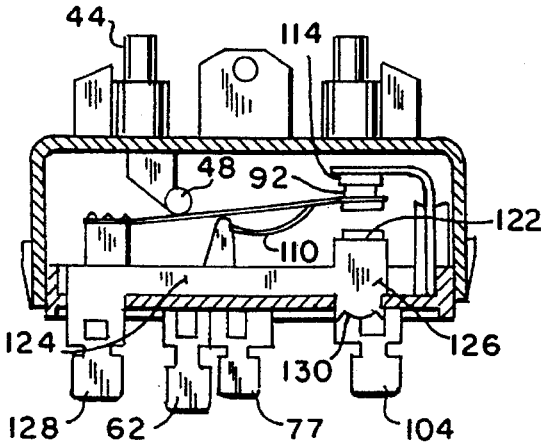
FIG. 6 is a cross-sectional view, taken along the lines 6—6 of FIG. 1.

For use and detailed explanation of the sequential operations of the first and second contact assemblies 18 and 20 of the switch 10, reference is made also to FIGS. 5 through 10. The neutral or unactivated position of the first and second contact assemblies are shown in FIGS. 5 and 6, which correspond to the schematic circuit diagrams of FIG. 11(*a*). In order to operate the switch in the manual-up mode, the right end (FIG. 1) of the actuating member 16 is depressed. This causes the second plunger rod 43 to move in the direction of arrow A (FIG. 5) so that the stem portion 47 thereof forces down the upper resilient blade member 66.

Figure 7:
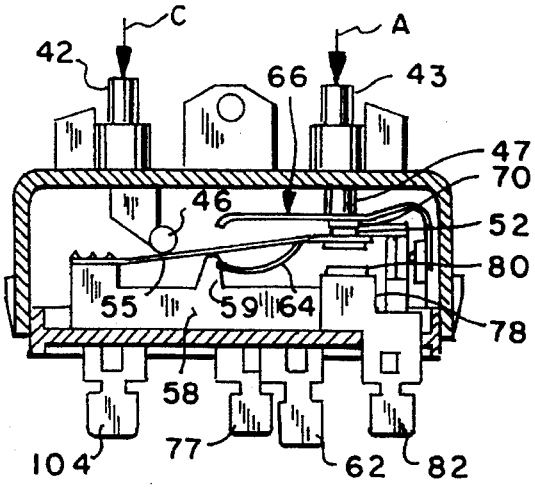
FIGS. 7 through 10 are cross-sectional views similar to FIGS. 5 and 6, illustrating the sequential operation of the first and second contact assemblies.
Figure 8:
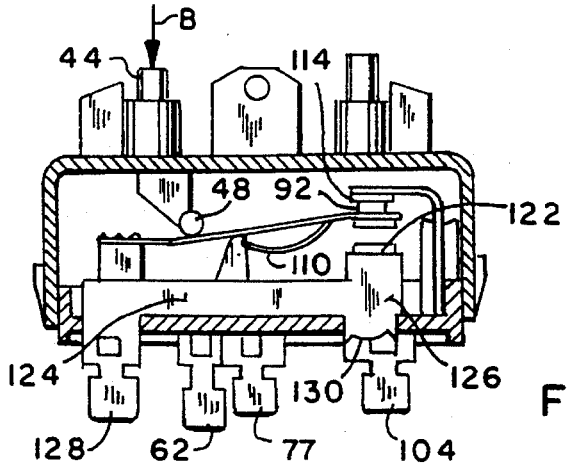
Figure 9:
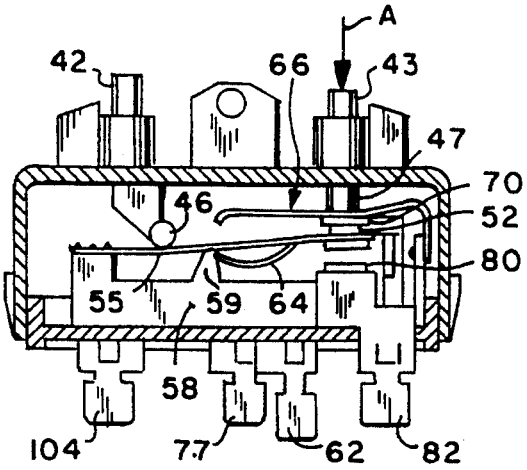

As a result, the movable contact element 70 of the blade member 66 is deflected into engagement with the contact element 52 of the first common contact blade member 50 so that electrical continuity is effective between the second terminal 77 and the first terminal 62. This is illustrated in FIG. 7 and corresponds to the schematic of FIG. 11(*b*). While these contact elements 70 and 52 can be "teased" in and out of engagement because they have no snap action, the prior art problems (i.e., switching a high current into an inductive load) have been avoided since this contact engagement does not yet apply any current to the motor load. In other words, both sides of the motor load are applied with the same potential IGN.

As the actuating member 16 is further depressed, the third plunger rod 44 is moved downward in the direction of arrow B (FIG. 8) so that the stem portion 48 thereof is pushed downwardly on the intermediate portion 96 of the second common contact blade member 90. After this intermediate portion 96 has been moved downward a sufficient amount about the fulcrum member 108, the compression member 110 will drive the free end of the second common contact blade member 90 downward with a snap action so as to cause disengagement of the contact element 92 thereon from the fixed contact element 114 of the upper fixed blade member 112 and to cause interengagement of the contact element 92 with the contact element 122 of the lower fixed blade member 120.

Figure 10:
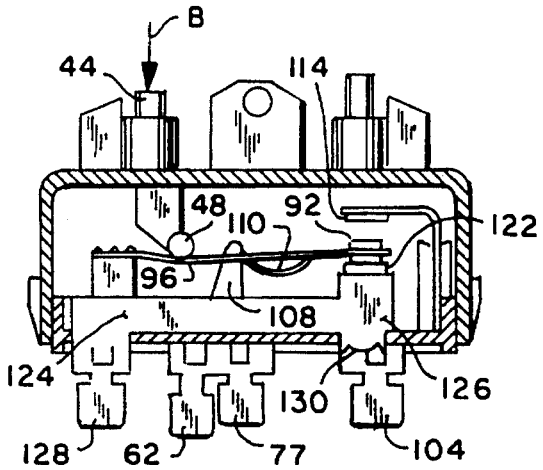
Figure 11A:
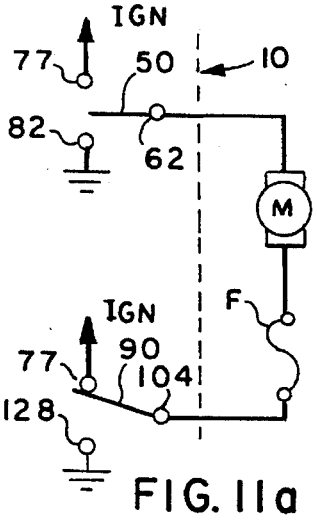
FIGS. 11(*a*)–11(*e*) are schematic circuit diagrams of the switch of FIG. 1 for controlling the operation of a driver's side window motor in an automotive vehicle, illustrating the sequential making and breaking operations of the first and second contact assemblies.
Figure 11B:
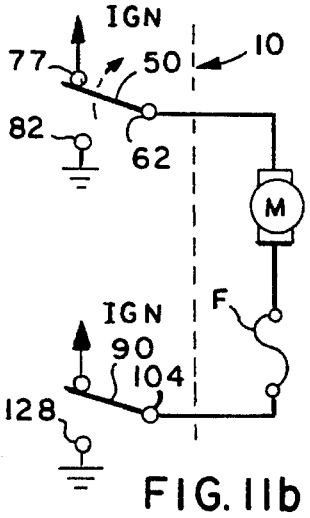
Figure 11C:
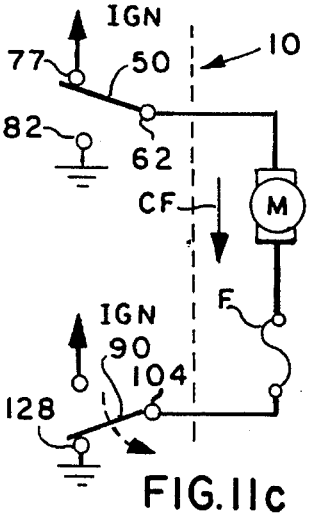
Figure 11D:
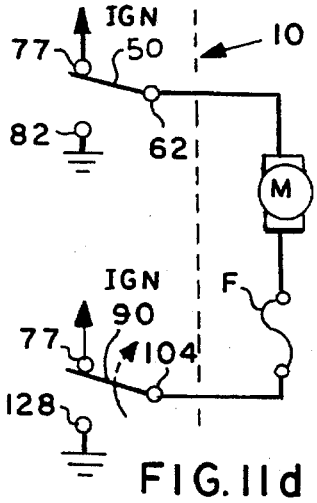
Figure 11E:
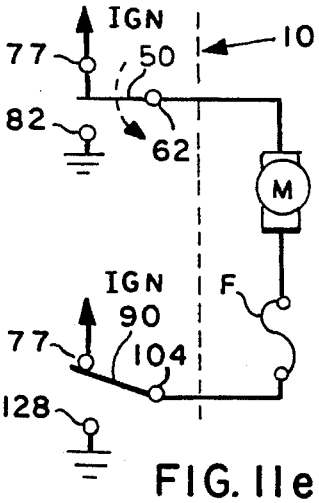

As a result, electrical continuity is effected between the fourth terminal 104 and the fifth terminal 128. This is illustrated in FIG. 10 and corresponds to the schematic of FIG. 11(*c*). Consequently, the circuit is completed and current will be conducted through the motor load for raising the window in the manual-up mode.

When the actuating member 16 is released, due to the manner in which the switch 10 is constructed the second common contact blade member 90 will first move up to snap back to its original position (FIG. 8) so that electrical continuity is interrupted between the motor M and the ground potential. This is illustrated in the schematic of FIG. 11(*d*). Thereafter, the upper resilient blade member 70 will be moved upward so as to return to its original rest position as shown in FIG. 5. This is depicted in the schematic of FIG. 11(*e*).

In order to operate the switch 10 in the down modes, the left end (FIG. 1) of the actuating member 16 is depressed. This causes the first plunger rod 42 to move downward in the direction of arrow C (FIG. 7) so that the stem portion 46 thereof is pushed downwardly on the intermediate portion 55 of the first common contact blade member 50. After this intermediate portion 55 has been moved downwardly a sufficient amount about the fulcrum member 59, the compression member 64 will drive the free end of the first common contact blade member 50 downward with a snap action so as to cause interengagement of the contact element 52 with the contact element 80 of the lower fixed blade member 78.

As a result, electrical continuity is effected between the first terminal 62 and the third terminal 82. Consequently, the circuit is completed again and current will be conducted through the motor load for lowering the window in the down modes of operation. It should be apparent to those skilled in the art that a current sensing power transistor may be used to complete the motor drive circuit so that the switch can be operated to lower the window automatically.

From the foregoing detailed description, it can thus be seen that the present invention provides an improved two-pole make-before-break switch which can be utilized for controlling the operation of a driver's side window motor in an automotive vehicle in either manual-up, manual-down, or automatic-down modes. The switch is constructed so that a first common contact blade member in a first contact assembly is closed prior to closing of another set of normally-open contacts with a snap action in a second contact assembly so as to complete an electrical connection. As a result, the problems associated with breaking or interrupting an inductive load have been avoided. Accordingly, it can be seen for these reasons that the switch of the instant invention represents a significant advancement in the art which has substantial merit from a commercial standpoint.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A two-pole make-before-break switch comprising:

a base housing;

a cover member secured to said base housing;

an actuating member disposed above said cover member;

a first contact assembly mounted on an interior portion of said base housing;

said first contact assembly including a first common contact blade member having a first contact element, an upper resilient blade member having a second contact element, and a lower fixed contact member having a third contact element, said first, second and third contact elements being electrically connected to a first terminal, a second terminal and a third terminal respectively disposed on the bottom exterior of said housing;

a spacer member being disposed for suspending said first contact element between said second and third contact elements when said switch is in the unactivated state;

said upper resilient blade member being movable between a first position where said second contact element is spaced apart from said first contact element and a second position where said second contact element is in engagement with said first contact element;

a second contact assembly mounted on an interior portion of said base housing;

said second contact assembly including a second common contact blade member having a fourth contact element, an upper fixed blade member having a fifth contact element, and a lower fixed blade member having a sixth contact element, said fourth, fifth and sixth contact elements being electrically connected to a fourth terminal, said second terminal and a fifth terminal respectively disposed on the bottom exterior of said base housing;

said second contact blade member being movable with a snap action between a first position where said fourth contact element is in engagement with said fifth contact element and a second position where said fourth contact element is in engagement with said sixth contact; and said actuator initially moving said upper resilient blade member of said first contact assembly so as to cause engagement of said first and second contact elements prior to the moving of said second common contact blade member so as to cause the snap action engagement of said fourth and sixth contact elements during a manual-up mode of operation.

2. A two-pole make-before-break switch as claimed in claim 1, wherein said first common contact blade member is movable with a snap action so as to cause engagement of said first contact element with said third contact element during down modes of operation.

3. A two-pole make-before-break switch as claimed in claim 1, wherein said actuating member is comprised of a first plunger rod for independently depressing said first common contact blade member, a second plunger rod for independently depressing said upper resilient blade member, and a third plunger rod for independently depressing said second common contact blade member.

4. A two-pole make-before-break switch as claimed in claim 1, wherein said first common contact blade member has a generally rectangular-shape and has a free end, and wherein a bowed thin leaf compression member has a first end which is formed integrally with the free end of said first common contact blade member and a second end thereof secured in said switch in compression so as to make the free end of said first common contact blade member operate with a snap action.

5. A two-pole make-before-break switch as claimed in claim 4, wherein said second common contact blade member has a generally rectangular-shape and has a free end, and wherein a bowed thin leaf compression member has a first end which is formed integrally with the free end of said second common contact blade member and a second end thereof secured in said switch in compression so as to make the free end of said second common contact blade member operate with a snap action.

6. A two-pole make-before-break switch as claimed in claim 1, wherein said base housing is molded of a suitable electrical insulating material.

7. A two-pole make-before-break switch as claimed in claim 1, wherein said cover member is molded of a suitable electrical insulating material.

8. A two-pole make-before-break switch as claimed in claim 1, wherein said actuating member is molded of a suitable electrical insulating material.

9. A two-pole make-before-break switch as claimed in claim 1, wherein said first and second contact assemblies are made of a suitable resilient conductive metallic material.

10. A two-pole make-before-break switch comprising:

a base housing;

a first contact assembly mounted on an interior portion of said base housing;

said first contact assembly including a first common contact blade member having a first contact element, an upper resilient blade member having a second contact element, and a lower fixed contact member having a third contact element, said first, second and third contact elements being electrically connected to a first terminal, a second terminal and a third terminal respectively disposed on the bottom exterior of said housing;

a spacer member being disposed for suspending said first contact element between said second and third contact elements when said switch is in the unactivated state;

said upper resilient blade member being movable between a first position where said second contact element is spaced apart from said first contact element and a second position where said second contact element is in engagement with said first contact element;

a second contact assembly mounted on an interior portion of said base housing;

said second contact assembly including a second common contact blade member having a fourth contact element, an upper fixed blade member having a fifth contact element, and a lower fixed blade member having a sixth contact element, said fourth, fifth and sixth contact elements being electrically connected to a fourth terminal, said second terminal and a fifth terminal respectively disposed on the bottom exterior of said base housing; and said second contact blade member being movable with a snap action between a first position where said fourth contact element is in engagement with said fifth contact element and a second position where said fourth contact element is in engagement with said sixth contact.

11. A two-pole make-before-break switch as claimed in claim 10, wherein said first common contact blade member is movable with a snap action so as to cause engagement of said first contact element with said third contact element during down modes of operation.

12. A two-pole make-before-break switch as claimed in claim 10, wherein said first common contact blade member has a generally rectangular-shape and has a free end, and wherein a bowed thin leaf compression member has a first end which is formed integrally with the free end of said first common contact blade member and a second end thereof secured in said switch in compression so as to make the free end of said first common contact blade member operate with a snap action.

13. A two-pole make-before-break switch as claimed in claim 12, wherein said second common contact blade member has a generally rectangular-shape and has a free end, and wherein a bowed thin leaf compression member has a first end which is formed integrally with the free end of said second common contact blade member and a second end thereof secured in said switch in compression so as to make the free end of said second common contact blade member operate with a snap action.

14. A two-pole make-before-break switch as claimed in claim 10, wherein said base housing is molded of a suitable electrical insulating material.

15. A two-pole make-before-break switch as claimed in claim 10, wherein said first and second contact assemblies are made of a suitable resilient conductive metallic material.

* * * * *